US010952539B2

(12) United States Patent
Dan-On

(10) Patent No.: US 10,952,539 B2
(45) **Date of Patent: *Mar. 23, 2021**

(54) MATTRESS WITH AN INTEGRATED MATTRESS ADJUSTMENT APPARATUS

(71) Applicant: COMFORT SYSTEMS (2007) LTD, Kfar Saba (IL)

(72) Inventor: Jehoshua Dan-On, Ra'anana (IL)

(73) Assignee: COMFORT SYSTEMS (2007) LTD, Kfar Saba (IL)

( * ) Notice: Subject to any disclaimer, the term of this patent is extended or adjusted under 35 U.S.C. 154(b) by 165 days.

This patent is subject to a terminal disclaimer.

(21) Appl. No.: 16/221,713

(22) Filed: Dec. 17, 2018

(65) Prior Publication Data

US 2019/0298075 A1 Oct. 3, 2019

(30) Foreign Application Priority Data

Mar. 27, 2018 (IL) ..... 258387

(51) Int. Cl.

| | |
|---|---|
| ***A47C 20/08*** | (2006.01) |
| ***A47C 20/04*** | (2006.01) |
| *A47C 19/04* | (2006.01) |
| *A61G 7/018* | (2006.01) |
| *A47C 23/15* | (2006.01) |

(52) U.S. Cl.

CPC ..... *A47C 20/08* (2013.01); *A47C 20/041* (2013.01); *A47C 19/045* (2013.01); *A47C 23/15* (2013.01); *A61G 7/018* (2013.01)

(58) Field of Classification Search

CPC ..... A47C 20/08; A47C 20/041; A47C 19/045; A47C 23/15; A61G 7/018

See application file for complete search history.

(56) References Cited

U.S. PATENT DOCUMENTS

| | | | | |
|---|---|---|---|---|
| 3,003,160 | A * | 10/1961 | Goodman | A47C 20/08 5/618 |
| 5,105,486 | A * | 4/1992 | Peterson | A47C 19/045 5/611 |
| 5,155,881 | A * | 10/1992 | Lafferty | A47C 20/08 5/186.1 |
| 10,568,434 | B2 * | 2/2020 | Kramer | A47C 20/041 |
| 2004/0237205 | A1 * | 12/2004 | McGettigan | A47C 27/144 5/727 |
| 2006/0026765 | A1 * | 2/2006 | Hornbach | A61G 7/015 5/618 |
| 2009/0094748 | A1 * | 4/2009 | Long | A47C 20/08 5/613 |
| 2016/0242558 | A1 * | 8/2016 | Rawls-Meehan | A61H 23/02 |
| 2017/0318977 | A1 * | 11/2017 | Rawls-Meehan | A47C 27/00 |

* cited by examiner

*Primary Examiner* — Robert G Santos
*Assistant Examiner* — Rahib T Zaman
(74) *Attorney, Agent, or Firm* — Roach, Brown, Mccarthy & Gruber, P.C.; Kevin D. McCarthy

(57) ABSTRACT

An adjustable mattress frame comprises a central body segment and upper and lower body adjustable segments pivotally connected by a hinge to said central body segment, said central body segment being provided with two actuation modules suitable to actuate said upper and lower body segments respectively.

7 Claims, 7 Drawing Sheets

MATTRESS WITH AN INTEGRATED MATTRESS ADJUSTMENT APPARATUS

FIELD OF THE INVENTION

The present invention relates to the field of comfort systems. More particularly, the invention relates to an adjustable mattress.

BACKGROUND OF THE INVENTION

Various forms of beds and mattresses have been used for centuries as a padded surface for supporting a reclining body. It is well known in the field of medicine and hospital beds that a static fully reclined bed and mattress may cause severe health issues, such as infections. The first adjustable bed was introduced in the early 1900's by Dr. Willis Dew Gatch, and to this day Dr. Gatch's basic idea of separating a bed into three segments and tilting each segment separately is practiced in hospitals and medical facilities worldwide.

As it has been realized that besides the health advantages, adjustable beds offer recreational and entertainment solutions, such as reading, watching television and using a laptop computer in bed, adjustable beds have become a common piece of furniture available in household bedrooms.

Typical adjustable beds comprise an adjustable base/frame (which in modern adjustable beds is adjusted electrically) and a regular mattress that doesn't differ from mattresses that are used in non-adjustable beds. However, adjustable beds present several disadvantages, such as the bulky presence of the equipment needed to move the various parts of the bed, the lack of ability to easily move the adjustable system to a different location, and the high cost of the entire system.

It would therefore be highly desirable to be able to provide an adjustable comfort system that is free from the above-mentioned disadvantages. It is an object of the present invention to provide such a comfort system. The term "comfort system", as used herein is meant to encompass adjustable systems suitable for different uses, such as simple sleeping, active resting (such as when reading, watching TV, using a laptop, etc.), as well as for health purposes, such as used in hospitals or at home with infirm or elderly people.

It is therefore an object of the present invention to provide a mattress that can be adjusted without use of an adjustable bed frame. It is another object of the present invention to provide such an adjustable mattress that can be easily serviced. It is a further object of the invention to provide an adjustable mattress that can be easily moved from one location to another, and which is cost effective as compared to adjustable bed frames.

Other objects and advantages of the invention will become apparent as the description proceeds.

SUMMARY OF THE INVENTION

The present invention relates to an adjustable mattress comprising a frame provided with a rectangular base segment and at least one rectangular segment pivotally connected by a hinge to the base segment, wherein the at least one segment is adjustable by an actuation apparatus in the base segment, and padding material located between said frame and at least one boundary material provided around them.

According to an embodiment of the invention, the frame comprises two adjustable segments on opposite sides of the base segment. In some embodiments of the invention, at least one adjustable segment comprises two sections, a first section abutting the base segment and the other section abutting the first section, and wherein sections are adjusted simultaneously.

According to one embodiment of the invention, the first section is actuated in the same manner an adjustable segment if actuated, and the second section comprises a top side pivotally connected by a hinge to the first section and a bottom side pivotally connected by arms to the base segment. According to another embodiment of the present invention, the frame further comprises a force absorbing apparatus suitable to absorb forces applied to the second section. In some embodiments of the invention, the frame comprises an upper body segment; a lower body segment; and a central body base segment.

The actuation apparatus typically (but not limitatively) comprises an electric motor, a linear actuator, and a motion-transmission module configured to transmit rotation of the motor to linear motion of the linear actuator. In some cases the at least one adjustable segment is connected to the linear actuator and is actuated thereby. According to another embodiment of the invention, the linear actuator is adapted to produce a linear motion that is transferred to the adjustable segment as a linear motion by levers that are pivotally fixed on one side to the adjustable segment and on the other side to the base segment.

The mattress may further comprise a power source suitable to provide power to the motor. Said power source can for instance be selected from an electrical cable configured to be connected to a power outlet, a battery cell, a rechargeable battery cell and a charge port, a power port configured to receive power from a remote battery cell, or a combination of two or more of said sources. According to some embodiments of the invention, the matters comprises a maintenance opening.

According to a further embodiment of the invention, the frame has a thickness of 8 cm or less, and in some embodiments the mattress does not exceed the height and weight of a standard mattress. According to still another embodiment of the present invention, the boundary material is that of a flexible mattress casing. The padding material can connected, in one instance, on a cover located on the top side of the adjustable frame and separating said frame from said padding material. The padding material can be of any suitable material and, for instance, it may comprise springs, foam, memory foam, gel, latex, or any combination thereof.

In another aspect, the present invention relates to an adjustable twin, king size or queen-size mattress system comprising two adjustable frames arranged parallel and adjacent to each other, padding material located above each adjustable frame, and flexible mattress-casing means enveloping said adjustable frames. In some embodiments of the present invention the mattress casing means consists of two separate casings comprising a fastening apparatus configured to bind them into a uniform structure and to allow separation thereof.

DETAILED DESCRIPTION OF THE INVENTION

Reference will now be made to an embodiment of the present invention, examples of which are provided in the accompanying figures for purposes of illustration only. One skilled in the art will readily recognize from the following description that alternative embodiments of the structures and methods exemplified herein may be employed, mutatis mutandis, without departing from the principles of the invention.

Figure 1:
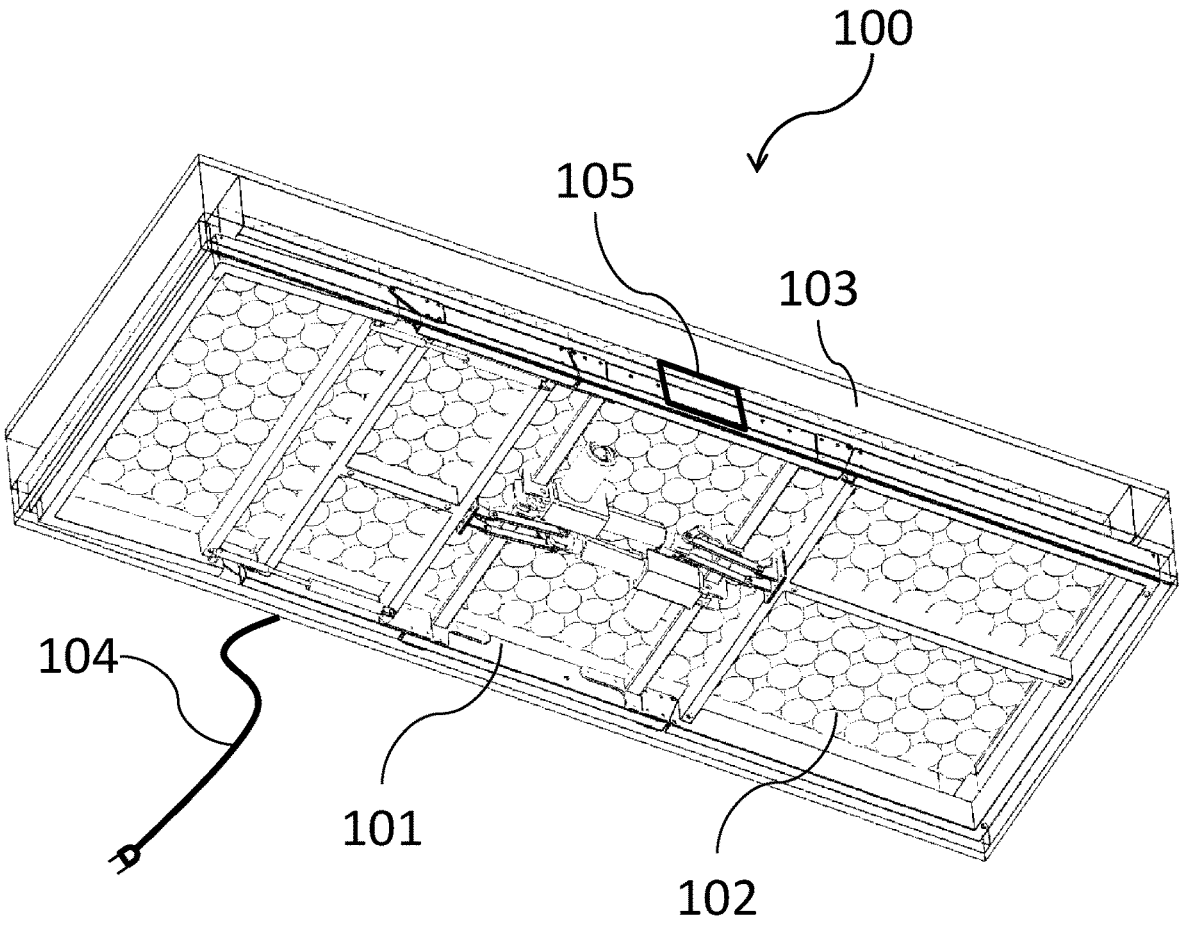
FIG. 1 shows a perspective view of an adjustable mattress, according to an embodiment of the present invention.

FIG. 1 shows a perspective view from the bottom side of an adjustable mattress 100, according to an embodiment of the present invention, comprising an adjustable frame 101, a padding apparatus 102 (e.g. springs, foam, memory foam, gel, latex, etc.), and a flexible mattress-casing 103 (shown transparent in FIG. 1). Padding apparatus 102 is situated on wooden planks that are connected to the top side of adjustable frame 101 such the top side of padding apparatus 102 imitates the position of frame 101. Consequently by adjusting frame 101 the position of the whole mattress 100 is adjusted.

Figure 2:
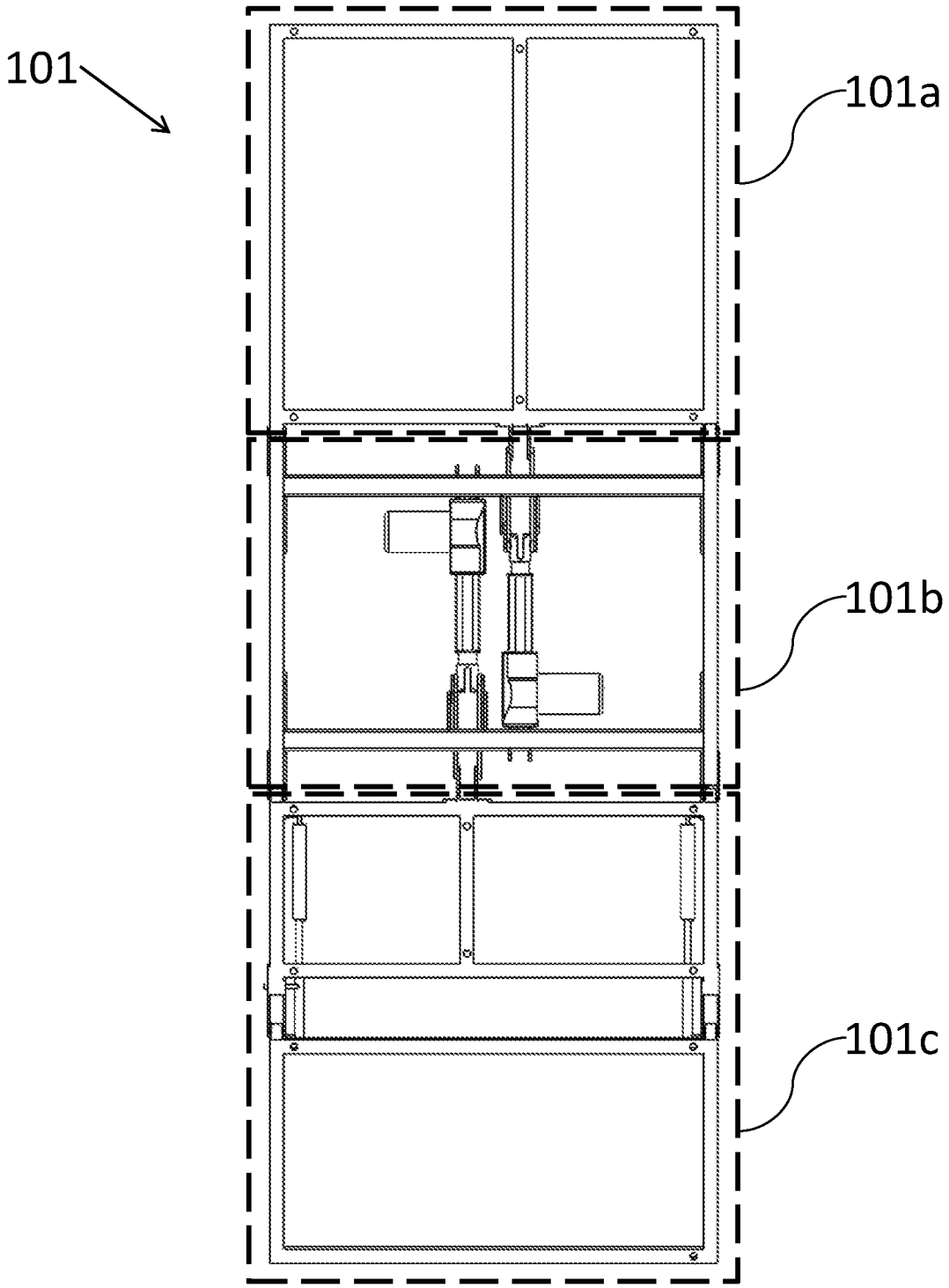
FIG. 2 shows a top view of an adjustable mattress frame according to an embodiment of the present invention.

FIG. 2 shows a top view of adjustable frame 101, according to an embodiment of the present invention, comprising three segments: upper body segment 101*a*, central body segment 101*b*, and lower body segment 101*c*, each made of metal profiles.

It should be noted that the adjustable mattress frame of the invention has the considerable advantage of being thin, thus permitting its incorporation in a mattress. The typical total height of frame 101 can be, for instance, 5-7.5 cm or even less if desired. Several different motors can be selected for actuating the frame, and those can be provided with different sizes.

Persons skilled in the art will easily provide actuating motors that are capable of delivering the required power. An illustrative and non-limitative example of a motor that is suitable for operating a frame according to the invention is an OD-11 electric motor available from ODIN® (www.o-din-manufacture.com, China), which generates a maximal thrusting force of 6000 N for the linear actuator to extend 50 mm, with a low noise operation in a 77 mm high package.

The frame and the elements that actuate it can be made of any suitable material that can withstand the mechanical forces applied thereto. Depending on the weight requirements for the final product, material such as industrial steel or other metal can be used, as well as light composite materials. Of course, the type of materials employed for the frame and its actuation will also impact the thickness of the assembly, as well as its weight and cost, and the skilled person will easily select the appropriate materials for an intended use.

It is noted that the present invention is not limited to a three segment frame, and may be performed with any other number of segments, e.g. four segments.

Figure 3:
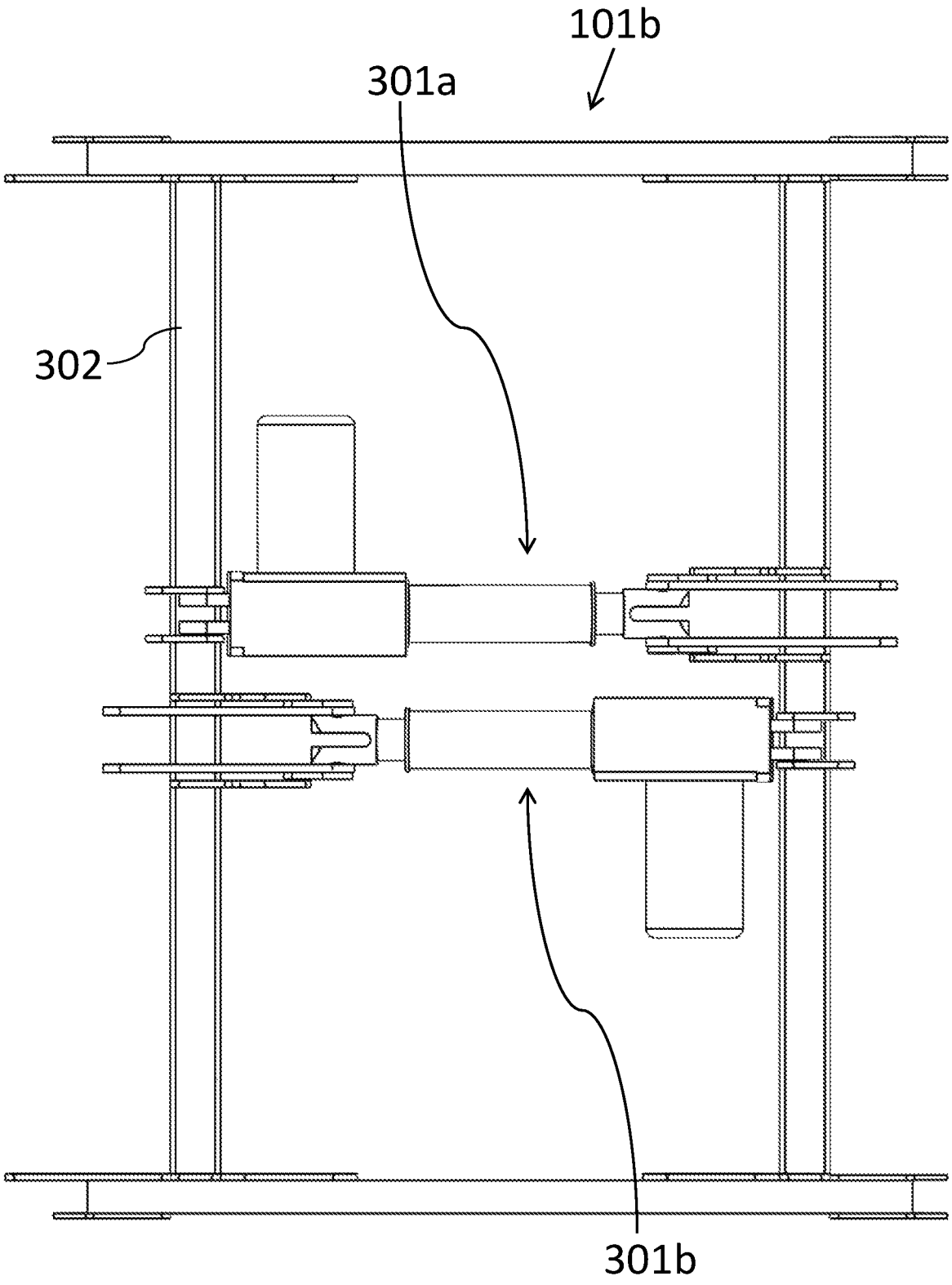
FIG. 3 shows a bottom view of the central body segment of the frame of FIG. 2, according to an embodiment of the present invention.

FIG. 3 shows a bottom view of central body segment 101*b*, according to an exemplary embodiment of the present invention, comprising an upper body actuation module 301*a* and a lower body actuation module 301*b*, both connected to substructure 302 which supports central body segment, 101*b*. Each actuation module 301*a* and 301*b* comprises a motor and a set of actuators and levers suitable to be actuated by the motor and to cause the upper and lower body segments to be adjusted, respectively, as explained in detail hereinbelow.

Figure 4A:
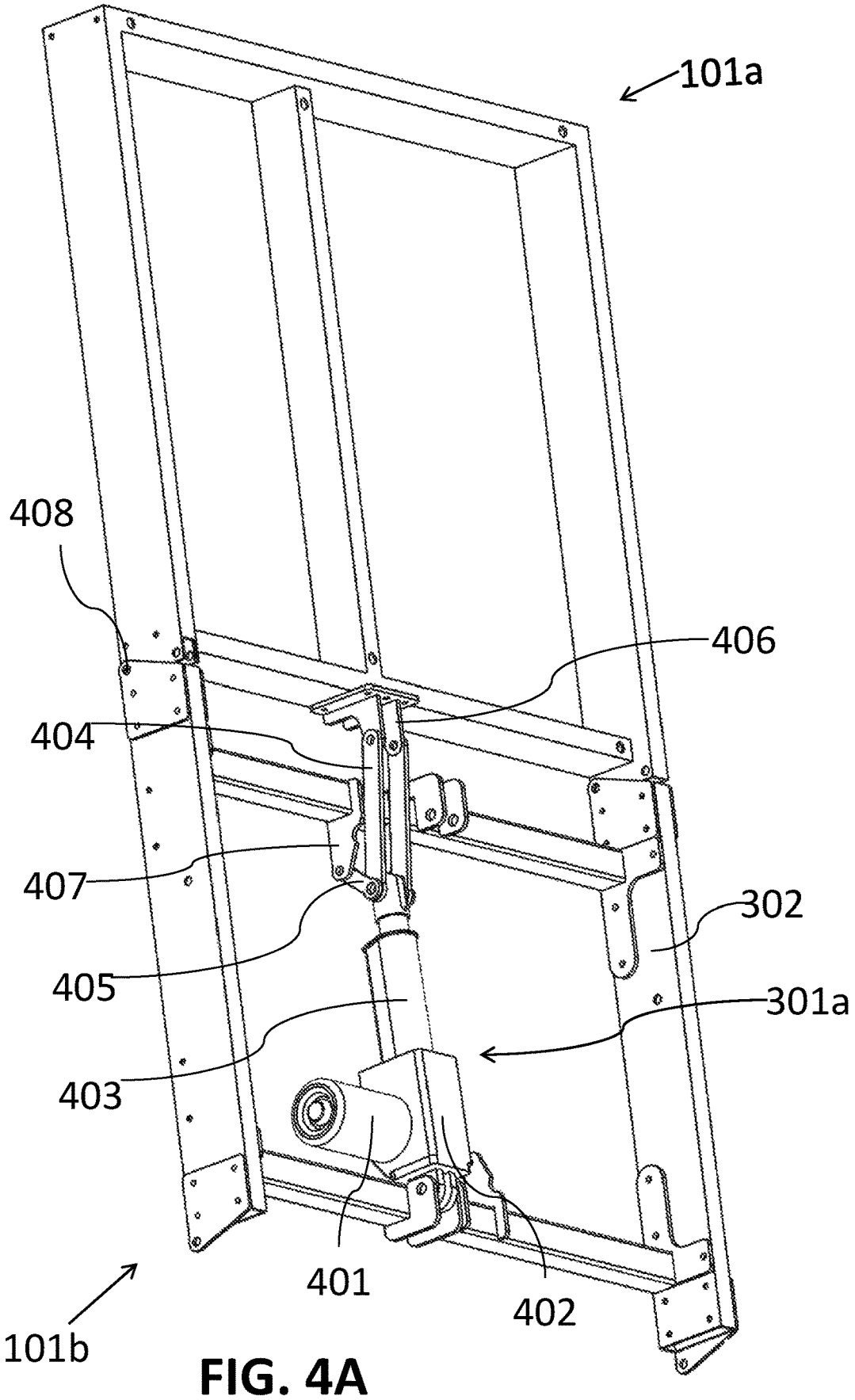
FIG. 4A schematically illustrates the upper body segment of the frame of FIG. 2 in a fully reclined position, according to an embodiment of the present invention.
Figure 4B:
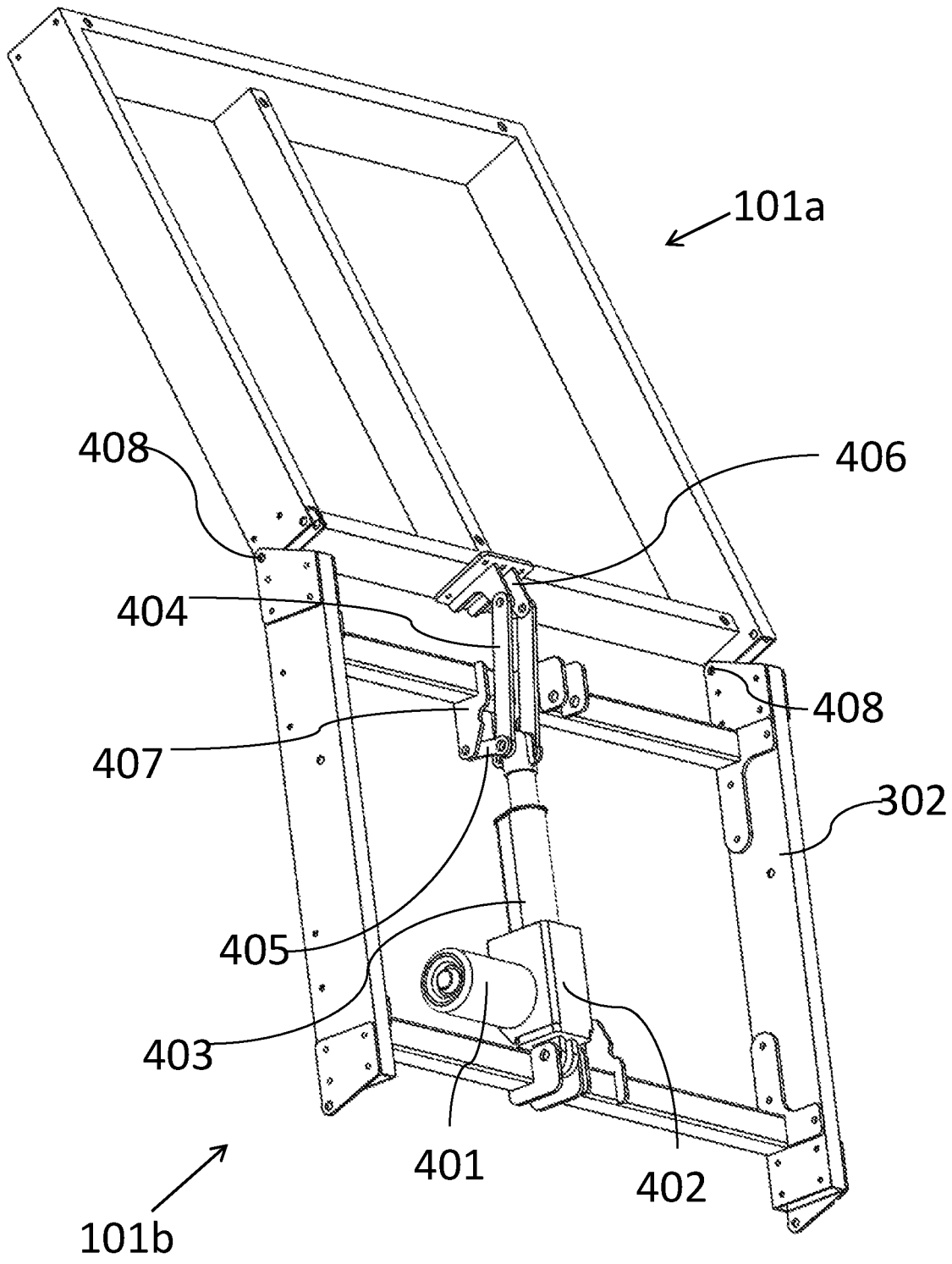
FIG. 4B shows the upper body segment of FIG. 2 in a partial upright position.

FIG. 4A schematically illustrates upper body segment 101*a* in a fully reclined position, along with upper body actuation module 301*a*, according to an embodiment of the present invention. Actuation module 301*a* comprises an electric motor 401, a motion-transmission module 402 and a linear actuator 403. Rotation of motor 401 is transmitted to linear motion of actuator 403 by transmission module 402, i.e. rotation in one direction of motor 401 causes linear actuator 403 to extend distally from transmission module 402, and rotation in the other direction causes linear actuator 403 to retract proximally into transmission module 402. The linear motion of actuator 403 is transferred to upper body segment 101*b* via levers 404 that are pivotally fixed to the upper body segment by anchoring members 406. According to an embodiment of the present invention, levers 404 are connected to substructure 302 via rotational levers 405 (that are pivotally fixed to anchoring members 407). Levers 405 are provided so as to maintain the motion of levers 404 above a predefined level which is determined by the length of levers 405. Upper body segment 101*a* is axially connected to substructure 302 at hinges 408. Linear distal actuation of actuation module 301*a* causes upper body segment 101*b* to be separated from central body segment 101*b*, however hinges 408 prevent complete separation of segments 101*a* and 101*b*. Consequently linear actuation of actuation module 301*a* causes segment 101*b* to rotate along hinges 408, as shown in FIG. 4B where upper body segment 101*a* is brought to a partially upright position by actuation module 301*a*.

When upper body segment 101*a* is tilted (i.e. not fully reclined) it is supported solely by center body segment 101*b*. Accordingly, motor 401 is required to resist the horizontal component of the torque collapsing force applied by upper body segment 101*a* being leaned upon. According to an embodiment of the present invention, motor 401 is capable of withstanding a load of up to 6000 Newton which is fairly enough relative to the weight applied by an average weighted person leaning on upper body segment 101*a*. Furthermore, the vertical component of force applied to the upper body segment is transferred to substructure 302 which is statically situated as the base of frame 101.

Figure 5A:
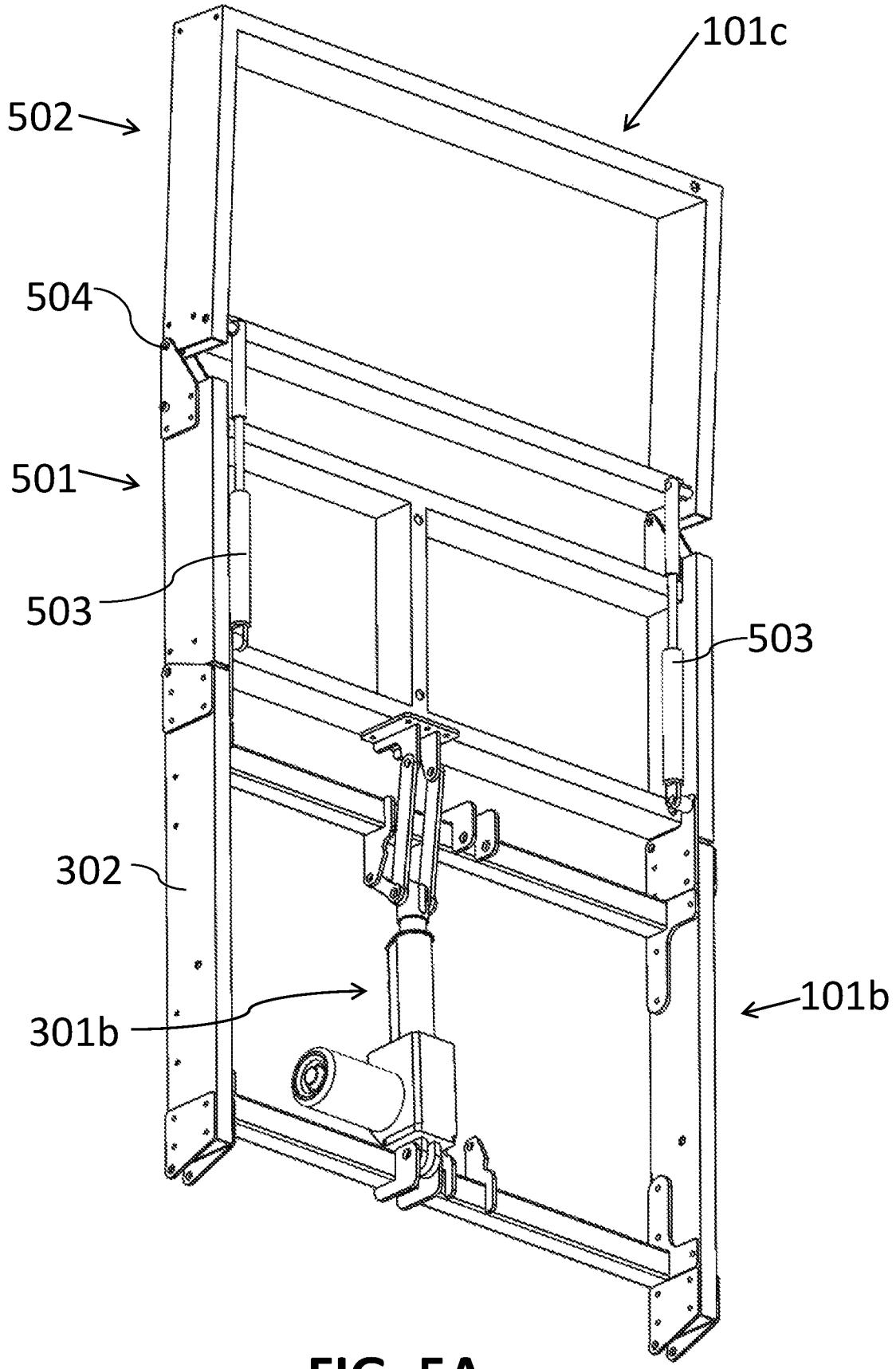
FIG. 5A schematically illustrates the lower body segment of the frame of FIG. 2 in a fully reclined position, according to an embodiment of the present invention.
Figure 5B:
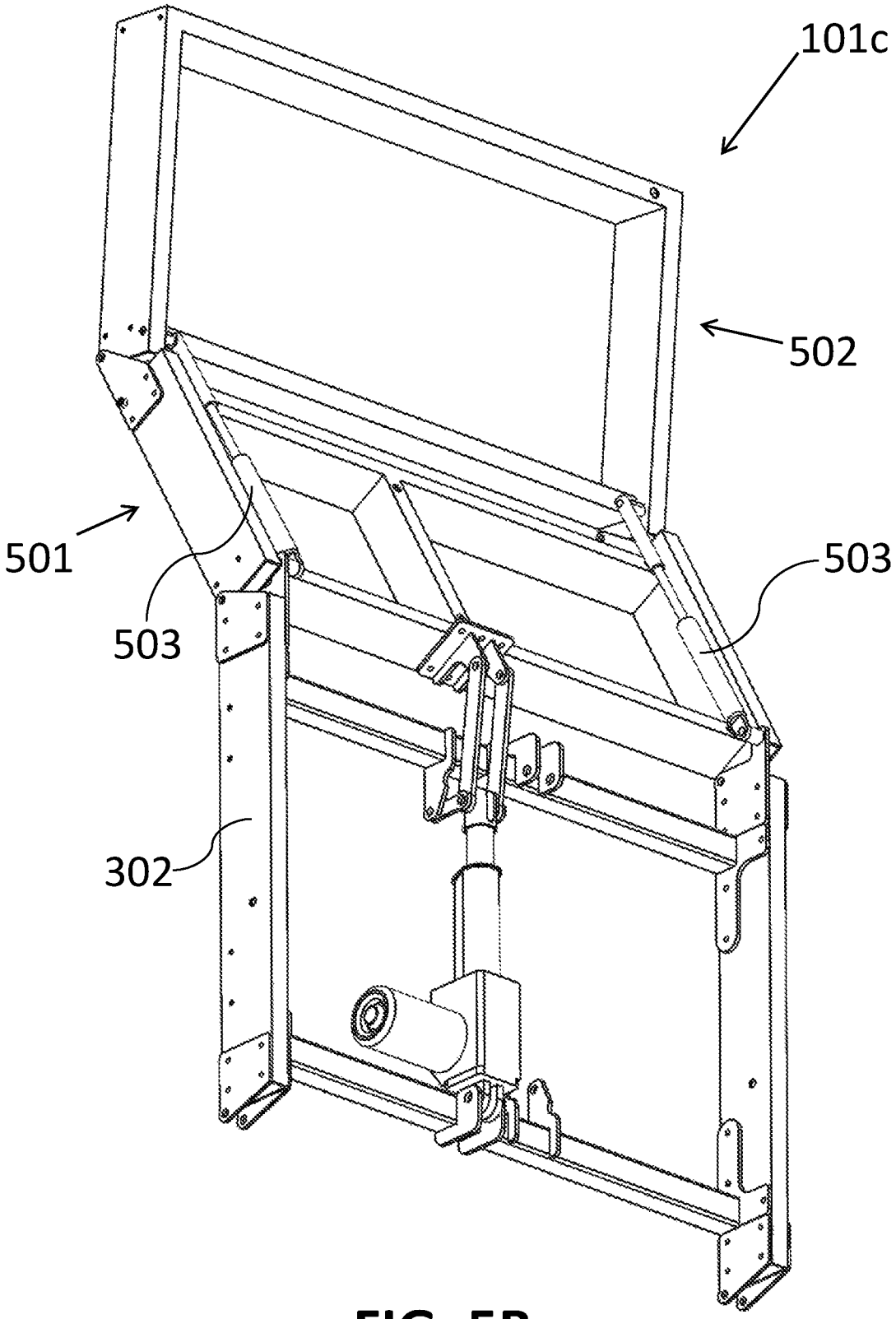
FIG. 5B shows the lower body segment of the frame of FIG. 2 in a not-fully reclined position, according to an embodiment of the present invention.

FIG. 5A schematically illustrates lower body segment 101*c* in a fully reclined position, along with lower body actuation module 301*b*, according to an embodiment of the present invention. Lower body segment 101*c* comprises a thigh section 501 and a calf section 502. The structure and operation of lower body actuation module 301*b* is identical to those of upper body actuation module 301*a*. According to an embodiment of the invention other actuation modules may be provided to either or both of the body actuation modules 301*a* and 301*b* and the invention is not limited to a specific actuation module or to the identicalness of the actuation modules. FIG. 5B shows lower body segment 101*c* in a not-fully reclined position in which thigh section 501 is tilted in a different angle than calf section 502.

Thigh section 501 is connected to substructure 302 in the same manner that upper body segment 101*a* is connected thereto. The bottom side of calf section 502 is connected to substructure by arms 503 for maintaining a constant distance between the two, while the top side of calf section 502 is axially connected to thigh section 501 by a hinge 504 thereby separating between the thigh and calf sections during tilting, as demonstrated in FIG. 5B.

Motor 505 is configured to resist the torque force applied by lower body segment 101*c* being leaned upon, much like motor 401 and upper body segment 101*a*. Arms 503 are further used for transferring collapsing forces from calf section 502 to substructure 302 which serves as the base of the adjustable frame 101.

According to an embodiment of the present invention, arms 503 comprise a force-absorbing apparatus, such as springs, pistons or other force absorbing apparatus, suitable to absorb forces applied to calf section 502. This embodiment is beneficial for preventing breaking of the connection between the calf section and thigh section or substructure 302 caused by heavy loads applied to calf section 502 and motor 505 being static and force-unabsorbent.

In order to control electric motors 401 and 505, an electrical cable (104 in FIG. 1) is provided for connecting the mattress 100 to an electric outlet. In this embodiment an emergency power port may be provided for changing the position of the mattress in case of power outage. According to another embodiment of the present invention, mattress 100 comprises a rechargeable battery cell (e.g. lithium) configured to provide electric power to the motors 401 and 505, and a power charge port. In this embodiment the battery cell may be used in case of a power outage when electricity isn't available to change the position of the mattress, e.g. from tilted to reclined. According to another embodiment of the invention, a mechanical damping apparatus is provided for gently reclining mattress 100 in case electrical power isn't available.

According to an embodiment of the invention, an opening 105 in one or more sides of mattress 100 is provided for maintenance of electrical and/or mechanical components, such as replacing a degraded battery cell.

In contrast to common adjustable twin beds, where two mattresses may be separately adjusted by adjusting the bed's base beneath each mattress, according to an embodiment of the present invention, a large mattress (e.g. king size) comprises two side-by-side frames 101 and two independent padding apparatuses 102, each on a frame 101, in order to adjust each side of the mattress separately. The flexible casing of the mattress comprises a fastening apparatus (e.g. a zipper) configured to bind the two independent padding apparatuses to a uniform large mattress and to allow separating of the mattress, for instance when separate adjusting is desired.

Frame 101 occupies a portion of the height of mattress 100, although it may be designed such that the height of the metal profiles, motors and other components of frame 101 allow padding apparatus to be high enough to provide the padding and comfort of a standard mattress while not exceeding the height of a standard mattress. According to an embodiment of the invention, the height of every component in frame 101 is less than 75 mm, leaving plenty of height for padding the mattress.

Although embodiments of the invention have been described by way of illustration, it will be understood that the invention may be carried out with many variations, modifications, and adaptations, without exceeding the scope of the claims.

The invention claimed is:

1. An adjustable mattress frame provided with a central base segment and with upper and lower body adjustable segments pivotally connected by a hinge to said central base segment, said central base segment being provided with two actuation modules suitable to actuate said upper and lower body segments respectively, wherein each actuation module comprises: a) an electric motor; b) a linear actuator adapted to produce a linear motion that is transferred to either the upper body adjustable segment or the lower body adjustable segment, by levers that are pivotally fixed on one side to the respective adjustable body segment that is being actuated and on the other side to the central base segment, wherein the actuation module that actuates the upper adjustable body segment transfers the linear motion to the upper body adjustable segment, and the actuation module that actuates the lower adjustable body segment transfers the linear motion to the lower body adjustable segment; and c) a motion-transmission module configured to transmit rotation of the motor to linear motion of the linear actuator; wherein the lower body adjustable segment comprises two sections: a first section abutting said central base segment, and a second section abutting the first section and comprising a top side pivotally connected by a hinge to the first section, and a bottom side pivotally connected by arms to said central base segment, and comprising a force absorbing apparatus suitable to absorb forces applied thereto; and wherein both sections are adjusted simultaneously.

2. The adjustable mattress frame according to claim 1, having a thickness not greater than 8 cm.

3. An adjustable mattress comprising the adjustable mattress frame according to claim 1, and further comprising a power source suitable to provide power to the motor, the power source being selected from:

A) an electrical cable configured to be connected to a power outlet;

B) a battery cell;

C) a rechargeable battery cell and a charge port;

D) a power port configured to receive power from a remote battery cell; or

E) a combination of two or more of the above.

4. An adjustable mattress comprising the adjustable mattress frame according to claim 1, and further comprising padding material positioned on the frame, and boundary material that encases said padding material.

5. An adjustable mattress comprising the adjustable mattress frame according to claim 1, which does not exceed the height and weight of a standard mattress.

6. An adjustable mattress comprising the adjustable mattress frame according to claim 1, further comprising a maintenance opening.

7. The adjustable mattress according to claim 4, wherein the padding material comprises one or more of springs, foam, memory foam, gel, or latex.

* * * * *